US005778753A

United States Patent [19]

Higgins

[11] Patent Number: 5,778,753

[45] Date of Patent: Jul. 14, 1998

[54] PNEUMATIC OR HYDRAULIC CYLINDERS

[75] Inventor: George Douglas Higgins, Roseville, Australia

[73] Assignee: Parker Hannifin Pty Limited, Castle Hill, Australia

[21] Appl. No.: 755,078

[22] Filed: Nov. 22, 1996

[30] Foreign Application Priority Data

Nov. 29, 1995 [AU] Australia ..... PN6877

[51] Int. Cl.[6] ..... F15B 15/28

[52] U.S. Cl. ..... 91/1; 91/307; 91/313; 91/390; 91/403; 91/410

[58] Field of Search ..... 91/1, 307, 313, 91/390, 403, 410

[56] References Cited

U.S. PATENT DOCUMENTS

| | | | |
|---|---|---|---|
| 3,537,356 | 11/1970 | Odell | 91/1 |
| 3,541,925 | 11/1970 | Guinot | 91/1 |
| 3,691,902 | 9/1972 | Lebzelter | 91/1 |
| 4,646,620 | 3/1987 | Buchl | 91/1 |

FOREIGN PATENT DOCUMENTS

| | | |
|---|---|---|
| A-27663/88 | 7/1989 | Australia . |
| 2449-216 | 9/1980 | France . |
| 3417447 A1 | 11/1985 | Germany . |
| 46-23089 | 9/1967 | Japan . |
| 1 350 006 | 4/1974 | United Kingdom . |
| 390 583 | 4/1975 | United Kingdom . |
| 1 477 609 | 6/1977 | United Kingdom . |
| 2 188 984 | 10/1987 | United Kingdom . |
| WO 96/02764 | 2/1996 | WIPO . |

OTHER PUBLICATIONS

Parker Hannifin Drawing No. B23157 dated 21 Jul., 1988 showing assembly drawing of pneumatic cylinder.

Copy of Australian Industrial Property Organisation International–Type Search Report for Natioanl Application No. PN 6877.

*Primary Examiner*—Sheldon Richter

*Attorney, Agent, or Firm*—John A. Molnar

[57] ABSTRACT

A pneumatic or hydraulic cylinder assembly (10) includes a cylinder (10), a piston (12) axially slidable within the cylinder (10), and structural elements are disposed within the cylinder (10) to issue a piston (12) position signal in response to the piston reaching a predetermined position.

24 Claims, 3 Drawing Sheets

PNEUMATIC OR HYDRAULIC CYLINDERS

The present invention relates to pneumatic or hydraulic cylinders.

The invention has been developed primarily for use with pneumatic cylinders and will be described hereinafter with reference to this application However, it will be appreciated that the invention is not limited to this particular field of use.

When using pneumatic cylinders, there is often a need to determine if and when the piston has reached the end of its stroke. Similarly, in double acting cylinders, it is often necessary to determine at which, if any, of the two end positions the piston is disposed.

Hitherto, end position sensing systems have generally relied on combinations of external mechanical, electrical, optical or magnetic sensors. Major disadvantages of these known sensing systems are that being external to the cylinder, they are susceptible to damage, corrosion, contamination, rapid wear due to their exposed environment and, in some cases, electrical or magnetic interference. They are also costly, complex and often unreliable.

Internal systems on the other hand pose reliability and maintenance problems due to the more restricted access.

It is an object of the invention to overcome or at least ameliorate one or more of these deficiencies of the prior art.

According to a first aspect, the invention provides a pneumatic or hydraulic cylinder assembly including a cylinder, a piston axially slidable within the cylinder, and signalling means disposed at least partially in the cylinder to issue a piston position signal in response to the piston reaching a predetermined position Preferably, the signalling means include a control fluid inlet in communication with the interior of the cylinder, and adapted to be closed when the piston reaches the predetermined position, thereby causing the piston position signal to issue. In the preferred embodiment, the control fluid inlet is closed by the piston directly occluding the inlet in the predetermined position.

In an alternative embodiment, the signalling means includes a valve actuator protruding into the cylinder interior. The valve actuator is preferably normally biased toward an open position and adapted to be closed by direct contact with the piston in the predetermined position, thereby closing the control fluid inlet and causing the piston position signal to issue.

In either case, the closure of the control fluid inlet preferably produces a piston position signal in the form of increased pressure in the control fluid line. The signaling means preferably fierier includes a signalling valve adapted to issue an output control signal in response to the piston position signal.

The above preferred embodiments of the invention are especially advantageous when used in hazardous areas where electrical systems are often not suitable, or in areas where strong magnetic fields are present rendering magnetic end position sensing systems unreliable.

In another embodiment, the output signal is used to activate an indicator. The indicator may be visual, tactile or audible and is preferably configured to alert operators to the piston reaching, or alternatively not reaching, the predetermined position. Alternatively or additionally, the output signal may be an electric, pneumatic, hydraulic, digital, analogue or other control signal used to activate, deactivate or somehow affect a control system or other equipment associated with the cylinder.

In a position holding embodiment, the output signal is used to maintain the piston at the predetermined position.

In a further embodiment, the piston position signal is an electrical, optical, mechanical or other signal issued in response to the piston reaching the predetermined position.

In another example, the cylinder includes an actuating fluid inlet and an actuating fluid outlet. Fluid flowing through the inlet and outlet is used to control the position of the piston. In use, the fluid passing through an unblocked control fluid inlet may be vented through the actuating fluid outlet. This fluid may be vented to atmosphere in the case of a pneumatic cylinder, or to a fluid reservoir in the case of a hydraulic cylinder.

In this example, the fluid passing through the actuating fluid inlet may be partially diverted through the line feeding the control fluid inlet and thereby into the cylinder interior. The fluid diverted to the control fluid inlet may pass through a restrictor before entering the cylinder interior through the control valve inlet. Desirably, the diverted fluid also passes through a non-return valve before passing trough the control fluid inlet, the non return being adapted to permit the diverted flow to only enter the cylinder interior. In this embodiment, closing of the control fluid inlet by the piston itself or by the piston closing a biased open valve results in the line pressure rise which causes the signalling valve to issue the previously defined output signal.

The signalling valve may be a three way directional valve and the actuating fluid inlet and outlet may be controlled by a five way directional valve.

In yet a further embodiment the cylinder is double acting and the signalling means may include two control fluid inlets disposed at either end of the cylinder, each respectively adapted to issue signals indicative of the piston reaching a respective end of the cylinder.

According to a second aspect, the invention provides an hydraulic or pneumatic door closing assembly including an hydraulic or pneumatic cylinder assembly as defined above, a door connected with the piston and adapted for movement between an open and a closed position, and valve means including a pressure sensor adapted to reverse a control valve and open the door when a predetermined level of resistance is encountered during the closing cycle before the piston has reached a predetermined position corresponding to the closed position of the door.

Preferred embodiments of the invention will now be described, by way of example only, with reference to the accompanying drawings in which.

Figure 1B:
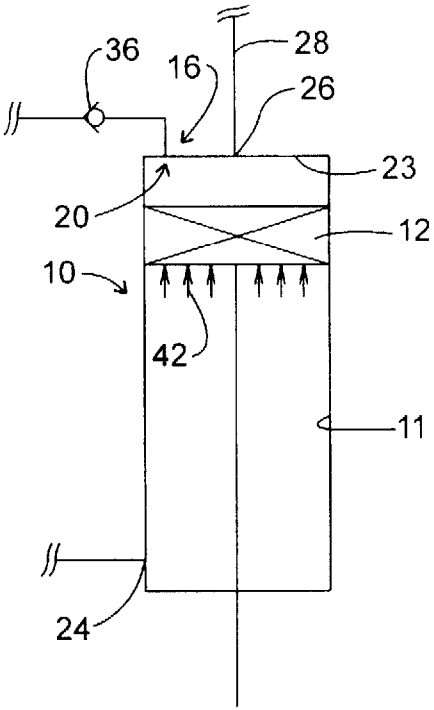
FIG. 1B is a schematic view of an alternative pneumatic cylinder to that shown in FIG. 1A.
Figure 1A:
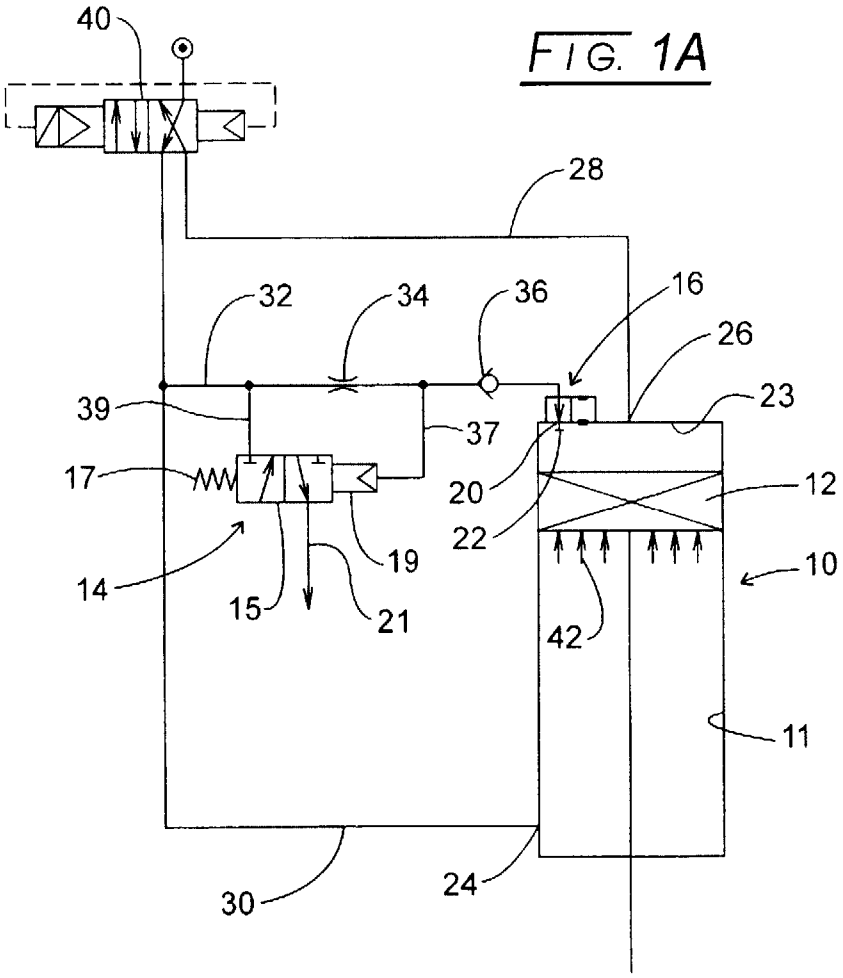
FIG. 1A is a schematic view of a pneumatic circuit including a pneumatic cylinder and piston position signalling means according to the invention.

Referring to FIG. 1A, there is shown a pneumatic cylinder 10 and a piston 12 is slidable in the interior 11 of the cylinder. Signalling means indicated generally at 14 include an actuator 16 in the interior 11 of the cylinder. The signalling means also include a three way spring closed signaling valve 15 with spring end 17 and pilot end 19. The signalling valve 15 is adapted to issue an output signal 21. The actuator 16 is operable in the interior 11 of the cylinder and is adapted to issue a piston position signal in response to the piston 12 reaching a predetermined position. The actuator 16 also includes a control fluid inlet 20 in fluid communication with the cylinder interior. The inlet 20 is adapted for closure by the piston reaching a predetermined position, which in this embodiment is the end of its stroke. The closure causes the piston position signal to issue. The piston position signal in turn causes the output signal 21 to issue, which is indicative of the piston reaching the predetermined position, as will be described in more detail below.

In the embodiment shown in FIG. 1A, the control fluid inlet 20 includes a valve 22 disposed generally in the cylinder end 23 and protruding into the cylinder interior 11. The valve 22 is spring biased toward the open position However, when the piston 12 reaches the end of its stroke, it comes into direct contact with the valve 22 and thereby forces it closed. The biasing mechanism automatically re-opens the valve 22 when the piston moves away from the cylinder end 23.

In the alternative cylinder configuration 10 shown in FIG. 1B the control fluid inlet 20 opens directly into the cylinder interior and is closed by the piston occluding the inlet when it reaches the cylinder end 23. The inlet is automatically opened when the piston moves away from cylinder end 23.

The embodiment of FIG. 1A also includes an actuating fluid inlet 24 and an actuating fluid outlet 26. The actuating fluid flowing through the inlet and outlet is used to control the position of the piston, as is well known in the art. A solenoid operated five-way directional valve 40 is used to control the fluid entering and leaving the cylinder through actuating fluid inlet 24 and the actuating fluid outlet 26 respectively. Fluid passing through open valve 22 is vented through actuating fluid outlet 26 via outlet line 28. The fluid passing through the inlet line 30 to the actuating fluid inlet 26 is partially diverted through line 32 past a restrictor 34 and a non-return valve 36 into the control fluid inlet 20. Valve 15 is connected in parallel to line 32 on either side of the restrictor 34 by branch lines 37 and 39.

The operation of the pneumatic cylinder shown in FIG. 1A will now be described. The five-way directional valve 40, in the position shown, causes line 30 to pressurise thus forcing the piston 12 to move in the direction indicated by arrows 42 towards the cylinder end 23. Fluid forced out of the cylinder is vented through line 28 and valve 40 to atmosphere. Line 32 is also pressurised and similarly vents through line 28 and valve 40 via outlet 26. Since no pressure is retained in line 32 downstream of the restrictor 34 when valve 22 is open, valve 15 is normally closed by spring 17 and no output signal 21 is issued.

When the piston reaches the cylinder end 23, it contacts valve 22 and forces it closed. This causes a pressure rise in line 32 which is diverted down branch line 37 into the valve pilot area 19. This pressure rise shifts the three-way valve 15 against its spring 17 and causes the output signal 21 to issue. The output signal 21 is used to activate an indicator, to notify personnel, or to signal a control system that the piston has reached the cylinder end 23. As previously foreshadowed, the actuator 16 and associated equipment can be provided at either or both ends of the pneumatic cylinder.

If the cylinder shown in FIG. 1B is substituted the operation, is identical except that the control fluid inlet 20 is closed by the piston 10 directly occluding the inlet, without the need for a separate valve mechanism or actuator. This variation is particularly desirable due to the simplicity of manufacture, relatively low cost, small number of moving parts and increased reliability.

Figure 2:
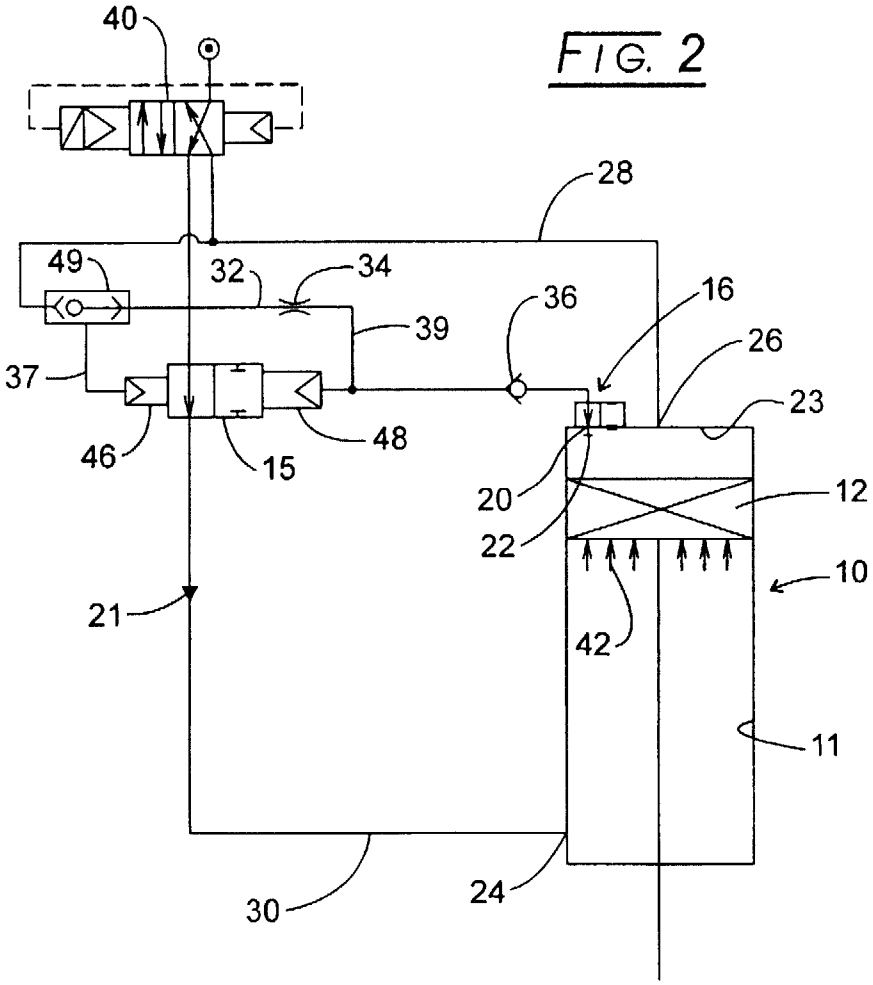
FIG. 2 is a schematic view of a pneumatic piston holding circuit including a cylinder and piston position signalling means according to the invention.

A second embodiment of the invention is shown in FIG. 2 wherein like features are denoted by corresponding reference numerals. This second-embodiment is used in situations where the cylinder is required to be held at an end position against a load for prolonged periods of time.

In this embodiment, the signalling valve 15 is a two-way directional valve having piloting area 46 smaller than piloting area 48 and operating in conjunction with shuttle valve 49. As discussed with reference to FIG. 1A, whilst the piston is moving towards the cylinder end 23, line 30 is pressurised, line 28 is vented to atmosphere and shuttle valve 49 is displaced to the right (when viewing the drawing) to ensure that valve 15 remains open. Fluid diverted through line 32 is also vented through line 28 via the cylinder interior 11. When the piston reaches cylinder end 23, valve 22 is closed and a consequential pressure rise occurs in line 32 and branch lines 37 and 39. This displaces the shuttle valve to the left (when viewing the drawing) such that equal pressures are maintained at piloting areas 46 and 48, the unequal surface areas of which cause the valve 15 to change from its open position, as shown, to a closed position The closing of valve 22 seals the pressure in line 30 thus holding the piston in the end position abutting the cylinder end 23. However, if, due to leakages, the piston moves away from cylinder end 23, valve 22 will reopen and pressure will escape from line 39. This causes a pressure drop at pilot area 48 which in turn causes valve 15 to open and issue an output signal 21. The output signal repressurises line 30 and cylinder 12 is forced back towards the end position 23. Accordingly, the output signal automatically maintains the piston at the end of the cylinder. It will be appreciated that the cylinder and valve arrangement shown in FIG. 1B could also be used in this embodiment of the invention.

Due to the intermittent nature of its operation, the embodiment shown in FIG. 2 only utilises pressure energy when necessary to compensate for leakage or increased load and thus results in significant energy savings over conventional holding circuits which normally rely on full line pressure to maintain a predetermined piston position.

Figure 3:
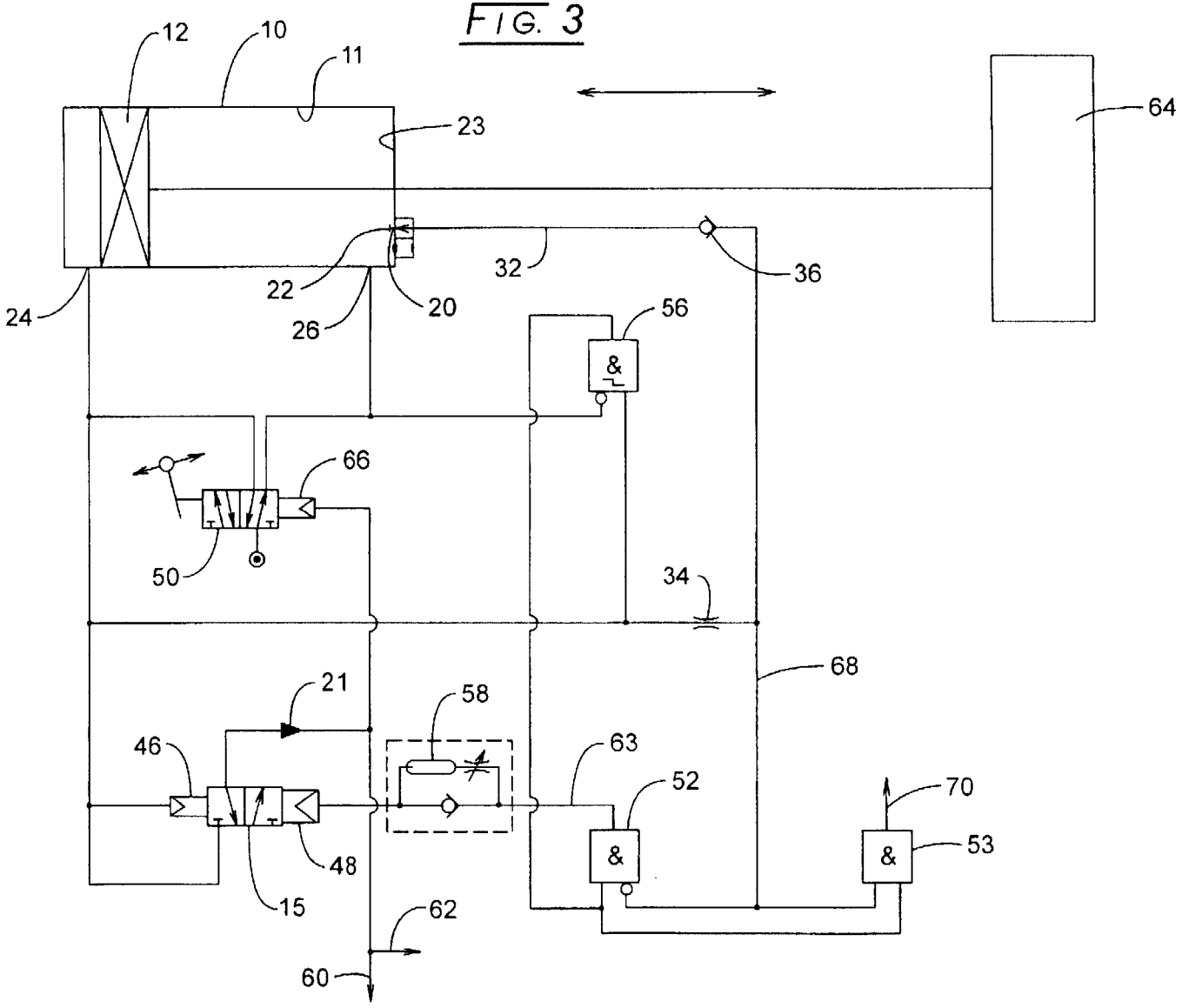
FIG. 3 is a schematic view of a pneumatic door operation circuit including a cylinder and piston position signing means according to the invention.

Turning now to FIG. 3, there is shown a third embodiment of the invention incorporated into a pneumatic door closing circuit which is configured to reduce the instance of injury caused by the door trapping a person during the closing cycle. As before, corresponding numerals will be used to designate like features. This third embodiment of the invention, in addition to the features previously described, includes a lever operated five-way valve 50 for opening and closing the door 64, connected to the piston 12, by displacement of the valve to the left or right respectively. The door can also be operated by a pneumatic pilot signal but the pilot signal can only open the door, and cannot close it.

This embodiment firer includes NOT element 52, AND element 53, door closed indicator 70, back pressure sensor 56, time delay 58, brake signal 60 and alarm signal 62, as described in more detail below.

In normal operation, the five-way valve 50 is manually operated to open and close the door 64. No pilot signal is generated at the valve piloting area 66. Further, the memory valve 15 is closed as shown. Back pressure sensor 56 is configured to issue an output signal when atmospheric (or slightly above atmospheric) pressure is present at the outlet 26 of the cylinder 10. In the presence of higher back pressure, no output signal is generated by sensor 56. NOT element 52 issues an output signal when a signal is received from back pressure sensor 56 and there is also no pressure build-up in pipe 68.

During the door closing cycle, pressure is present at inlet 24 of the cylinder and the motion of piston 12 generates some back pressure at outlet 26. When the piston has come to a halt, either at or before the end of its stroke, any back pressure at outlet 26 quickly decays.

In a normal closing operation, the piston 12 will come to a halt at the end of its stroke at cylinder end 23. This piston position corresponds to the door being fully closed. Whilst in this position, valve 22 is closed and pressure builds up in line 32 which prevents NOT element 52 from sending a signal through line 63. As a consequence, the signalling valve 15 remains closed, the door cannot be reversed, and no alarm or brake signal is generated at 60 or 62.

However, if an obstacle is trapped by the closing door, the piston will come to a halt before reaching the end of its stroke and valve 22 will remain open, thus allowing the pressure in line 32 to vent to atmosphere. As there is no pressure build-up in line 32, the NOT element 52 is ready for sending a signal through line 63.

With the back pressure at cylinder outlet 26 decaying, the back pressure sensor 56 generates a back pressure signal which, in turn, causes the NOT element 52 to send a signal to time delay valve 58. This signal goes through time delay 58 unrestricted and opens signalling valve 15. The output signal 21 from the signalling valve 15 reverses the five-way valve 50 causing the piston direction to be reversed and the door to open. If required, the branches from this output signal at 62 and 60 can also cause an alarm to sound and/or the brakes of the conveyance to be applied. The circuit can be reset and the door closed only after the expiration of the period set on the time delay 58. When the time delay at 58 has expired, the circuit is reset by shifting the five-way valve to the door closed position When the piston is at cylinder end 23, the AND element 53 will produce an indicator signal 70 which may be used to actuate a visual or similar indicator. This indicator is generally mounted on the dashboard of the conveyance to indicate to the operator that the door is fully closed. As with the previous embodiment, the cylinder of FIG. 1B could also be used in this door control environment.

This system is especially advantageous where a pneumatic cylinder is employed to open and close doors on public vehicles, buildings or other industrial applications. In these applications, it is extremely desirable that the door automatically opens if anything or anybody is trapped by the closing door and, if required, an alarm sounded and/or a brake applied.

Although the invention has been described with reference to specific examples, it will be appreciated by those skilled in the art that the invention may be embodied in many other forms. In particular, provided suitable reservoirs are in place, the system is readily adaptable to be used in hydraulic circuits with hydraulic cylinders also.

What is claimed is:

1. A position signaling fluid cylinder assembly of a variety operable within a fluid power system under the control of an actuating fluid pressure for the reciprocating movement of an element thereof, said cylinder comprising:

a cylinder housing defining an interior extending axially from a first end to a second end, said housing having at least a first actuating fluid port opening into fluid communication with said interior, and at least one associated control fluid port opening into fluid communication with said interior and said actuating fluid port, said control fluid port being couplable in fluid communication with a control fluid pressure to admit said control fluid pressure into said interior, and said actuating fluid port being operable to vent said control fluid pressure from within said interior, and a piston movable axially within said interior from a first position intermediate one of said ends of said interior and said actuating and control fluid ports to a predetermined second position, said piston being adapted when disposed in said second position to effect the closing of said fluid communication between said actuating fluid port and said control fluid port and an increase of said control fluid pressure deriving a fluid pressure signal responsive to the disposition of said piston in said second position.

2. The fluid cylinder assembly of claim 1 wherein said second position defines the end of the stroke of said piston.

3. The fluid cylinder assembly of claim 1 further comprising:

a flow control valve interposed in fluid communication between said control fluid pressure and said control fluid port, said valve being movable from a normally opened orientation effecting the admittance of said control fluid pressure into said interior of said cylinder to a closed orientation closing said fluid communication between said actuating fluid port and said control fluid port; and a actuator disposed with said interior of said cylinder and operably coupled to said valve to control the opening and closing thereof, said actuator being engaged by said piston when said piston is disposed in said second position and being responsive to said engagement to move said valve from said opened to said closed orientation.

4. The fluid cylinder assembly of claim 1 wherein said cylinder housing further has a second actuating fluid port opening into fluid communication with said interior of said cylinder intermediate said piston and said one of said ends of said interior, said second actuating fluid port being spaced-apart axially from said first actuating fluid port and being couplable in fluid communication with said actuating fluid pressure to admit said pressure into said interior for controlling the movement of said piston from said first to said second position.

5. The fluid cylinder assembly of claim 1 wherein said piston closes said control fluid port when said piston is disposed in said second position.

6. The fluid cylinder assembly of claim 5 wherein said piston has a surface configured to cover said control fluid port when said piston is disposed in said second position.

7. The fluid cylinder assembly of claim 1 wherein said actuating fluid and said control fluid port open into the other one of said ends of said interior.

8. The fluid cylinder assembly of claim 7 wherein said piston closes said control fluid port when disposed in said second position.

9. The fluid cylinder assembly of claim 8 wherein said piston has a surface configured to cover said control fluid port when said piston is disposed in said second position.

10. The fluid power system of claim 1 wherein said actuating fluid and said control fluid port open into the other one of said ends of said interior.

11. The fluid power system of claim 10 wherein said piston closes said control fluid port when disposed in said second position.

12. The fluid power system of claim 11 wherein said piston has a surface configured to cover said control fluid port when said piston is disposed in said second position.

13. A fluid power system for issuing a signal corresponding to the position of a reciprocatingly movable element thereof, said system comprising:

a fluid source for providing control and actuating fluid pressures; and a fluid cylinder coupled in fluid communication with said fluid source and operable under the control of said actuating fluid pressure, said cylinder comprising:

a cylinder housing defining an interior extending axially from a first end to a second end, said housing having at least a first actuating fluid port opening into fluid communication with said interior, and at least one associated control fluid port opening into fluid communication with said interior and said actuating fluid port, said control fluid port being coupled in fluid communication with said control fluid pressure to admit said control fluid pressure into said interior, and said actuating fluid port being operable to vent said control fluid pressure from within said interior, and a piston movable axially within said interior from a first position intermediate one of said ends of said interior and said actuating and control fluid ports to a predetermined second position, said piston being adapted when disposed in said second position to effect the closing of said fluid communication between said actuating fluid port, and said control fluid port and an increase of said control fluid pressure deriving a fluid pressure signal responsive to the disposition of said piston in said second position.

14. The fluid power system of claim 13 further comprising a signaling valve coupled in fluid communication with said fluid source and said control fluid port of said cylinder, said signaling valve being responsive to said fluid pressure signal to issue an output control signal.

15. The fluid power system of claim 13 wherein said cylinder further comprises:

a flow control valve interposed in fluid communication between said control fluid pressure and said control fluid port, said valve being movable from a normally opened orientation effecting the admittance of said control fluid pressure into said interior of said cylinder to a closed orientation closing said fluid communication between said actuating fluid port and said control fluid port; and a actuator disposed with said interior of said cylinder and operably coupled to said valve to control the opening and closing thereof, said actuator being engaged by said piston when said piston is disposed in said second position and being responsive to said engagement to move said valve from said opened to said closed orientation.

16. The fluid power of claim 13 wherein said cylinder housing further has a second actuating fluid port opening into fluid communication with said interior of said cylinder intermediate said piston and said one of said ends of said interior, said second actuating fluid port being spaced-apart axially from said first actuating fluid port and being couplable in fluid communication with said actuating fluid pressure to admit said pressure into said interior controlling the movement of said piston from said first to said second position, and wherein said system further comprises:

a first directional valve coupled in fluid communication with said fluid source, said first and said second actuating fluid ports, and a fluid pressure vent, said directional valve being operable to supply said actuating fluid pressure to said second actuating fluid port and said control fluid pressure to said control fluid port, and to couple said first actuating fluid port in fluid communication with said vent; and a second directional valve coupled in fluid communication with said control fluid port of said cylinder and interposed in fluid communication between said first directional valve and said second directional valve, said second directional valve being normally opened to admit the supply of said actuating fluid pressure to said second actuating fluid port, and being responsive to said fluid pressure signal to discontinue the supply of said actuating fluid pressure to said second actuating fluid port.

17. The fluid power system of claim 13 wherein said piston closes said control fluid port when said piston is disposed in said second position.

18. The fluid power system of claim 17 wherein said piston has a surface configured to cover said control fluid port, when said piston is disposed in said second position.

19. The fluid power system of claim 13 wherein said cylinder housing further has a second actuating fluid port opening into fluid communication with said interior of said cylinder intermediate said piston and said one of said ends of said cylinder, said second actuating fluid port being spaced-apart axially from said first actuating fluid port and being couplable in fluid communication with said actuating fluid pressure to admit said pressure into said interior controlling the movement of said piston from said first to said second position, and wherein said system further comprises a directional valve coupled in fluid communication with said fluid source, said first and said second actuating fluid ports, and a fluid pressure vent, said directional valve being operable in a first orientation to supply said actuating fluid pressure to said second actuating fluid port and said control fluid pressure to said control fluid port, and to couple said first actuating fluid port in fluid communication with said vent, and being operable in a second orientation to supply said actuating fluid pressure to said first actuating fluid port controlling the movement of said piston from said second position to said first position, and to couple said second actuating fluid port and said control fluid port in fluid communication with said vent.

20. The fluid power system of claim 19 further comprising a one-way valve interposed in fluid communication between said control fluid port and said directional valve, said one-way valve admitting the supply of control fluid pressure to said control fluid port when said directional valve is disposed in said first orientation, and delimiting the venting of actuating fluid pressure through said control fluid port when said directional valve is disposed in said second orientation.

21. The fluid power system of claim 19 further comprising a signaling valve coupled in fluid communication with said control fluid port of said cylinder and said directional valve, said signaling valve being responsive to said fluid pressure signal when said directional valve is disposed in said first orientation to issue an output control signal.

22. In a fluid power system including a fluid source for providing control and actuating fluid pressures and a fluid cylinder coupled in fluid communication with said fluid source and operable under the control of the actuating fluid pressure for the reciprocating movement of an element thereof, a method of issuing a position signal corresponding to the position of said element of said cylinder comprising the steps of:

(a) providing said cylinder as comprising:

a cylinder housing defining an interior extending axially from a first end to a second end, said housing having at least a first actuating fluid port opening into fluid communication with said interior, and at least one associated control fluid port opening into fluid communication with said interior and said actuating fluid port; and a piston movable axially within said interior from a first position intermediate one of said ends of said interior and said actuating and control fluid ports to a predetermined second position, said piston being adapted when disposed in said second position to effect the closing of said fluid communication between said actuating fluid port and said control fluid port;

(b) coupling said control fluid port in fluid communication with said control fluid pressure to admit said control fluid pressure into said interior of said cylinder; and (c) moving said piston from said first position to said second position to effect an increase of said control fluid pressure deriving a fluid pressure signal responsive to the disposition of said piston in said second position.

23. The method of claim 22 wherein said piston closes said control fluid port when said piston is disposed in said second position.

24. The method of claim 22 wherein said cylinder is provided with said housing as further having a second actuating fluid port opening into fluid communication with said interior of said cylinder intermediate said piston and said one of said ends of said interior, and wherein said piston is moved in step (c) by coupling said second actuating fluid port in fluid communication with said actuating fluid pressure to admit said pressure into said interior of said cylinder.

* * * * *